US005139008A

United States Patent [19]

Timpano

[11] Patent Number: 5,139,008

[45] Date of Patent: Aug. 18, 1992

[54] SOLID FUEL BURNING STOVE WITH SECONDARY AIR HEAT EXCHANGER

[75] Inventor: Bruno Timpano, Woodbridge, Canada

[73] Assignee: Reverso Manufacturing Ltd., Woodbridge, Canada

[21] Appl. No.: 687,558

[22] Filed: Apr. 19, 1991

[51] Int. Cl.[5] ..... F24C 1/14

[52] U.S. Cl. ..... 126/77; 126/60; 126/112

[58] Field of Search ..... 126/77, 60–64, 126/112, 307 R, 312, 67, 65, 66, 80, 81, 98, 522, 531, 529, 523; 110/214, 210; 237/50, 52

[56] References Cited

U.S. PATENT DOCUMENTS

| | | | |
|---|---|---|---|
| 4,232,650 | 11/1980 | Frank | 126/77 |
| 4,316,444 | 2/1982 | Gullickson | 126/77 |
| 4,643,165 | 2/1987 | Chamberlain | 126/77 |
| 4,941,451 | 7/1990 | Gilham | 126/77 |

*Primary Examiner*—James C. Yeung

[57] ABSTRACT

A solid fuel burning stove of the present invention includes an internal combustion chamber, a primary air feed to the combustion chamber and a heat exchanger above and providing a secondary heated air feed to the combustion chamber. This secondary air feed raises burning temperatures and reduces pollutants from the exhaust of the stove. The heat exchanger itself has a horizontally layered substantially closed box-like construction including a heated gas outflow layer fed by the hot exhaust gases from the combustion chamber, at least one secondary air inflow layer into which secondary air is drawn from outside of the stove, a heat exchange wall between and isolating the gas outflow layer from the secondary air inflow layer and an air feed from the secondary air flow layer to the combustion chamber. The heat exchanger further includes an exhaust stack receiving opening for fitting an exhaust stack with the gas outflow layer without penetrating the secondary air inflow layer.

5 Claims, 3 Drawing Sheets

FIG.3.
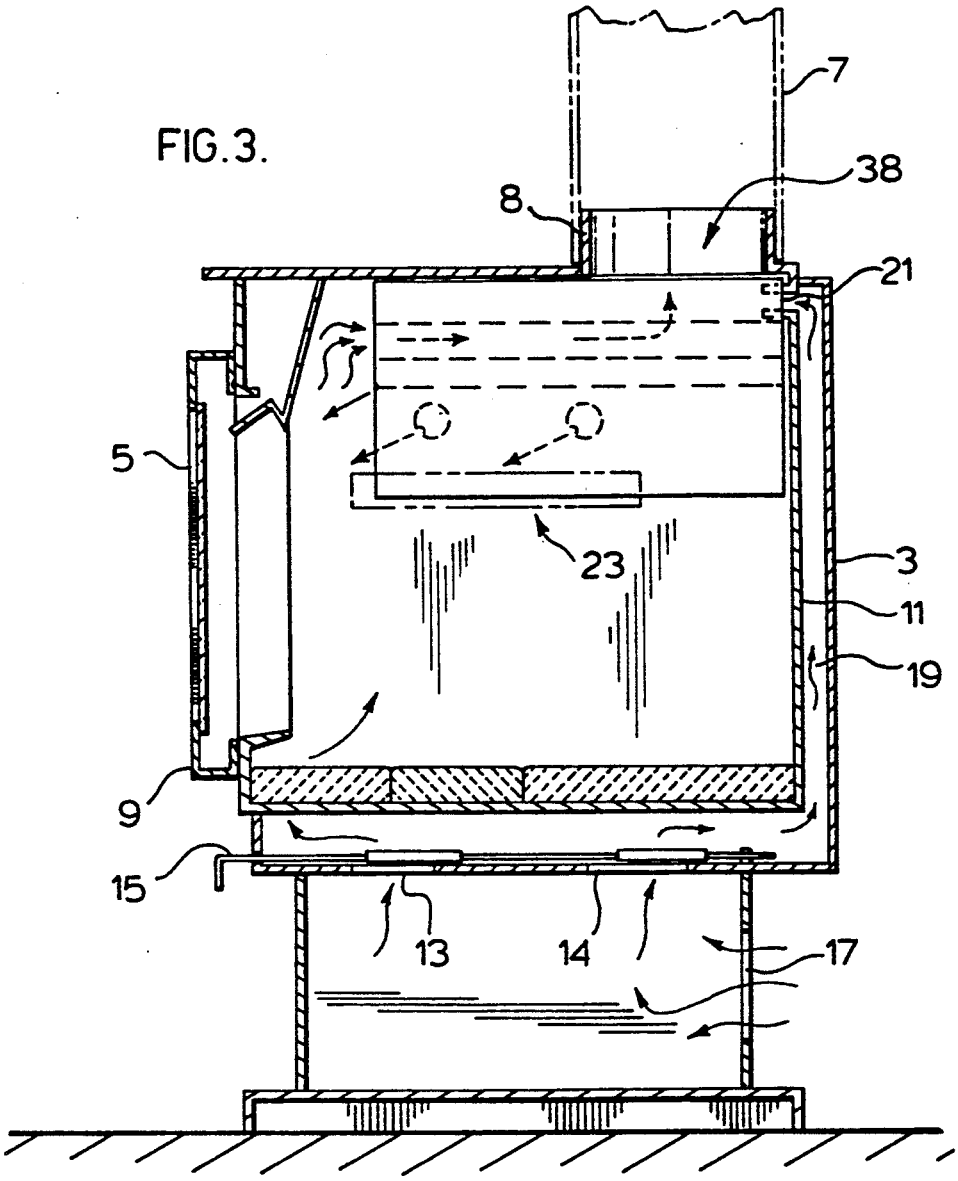
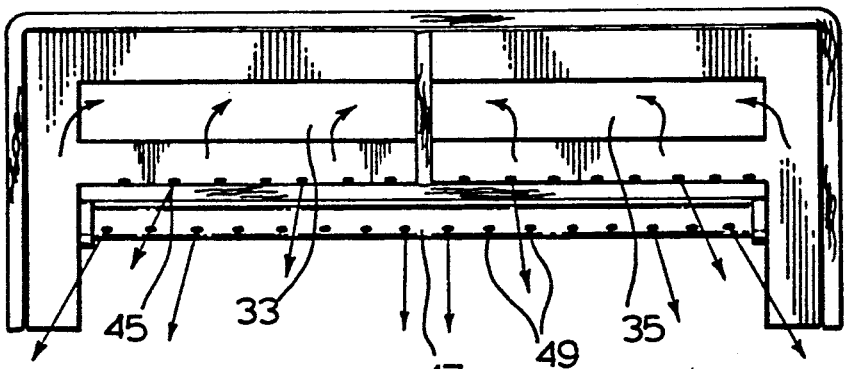
FIG.4.

SOLID FUEL BURNING STOVE WITH SECONDARY AIR HEAT EXCHANGER

FIELD OF THE INVENTION

The present invention relates to a solid fuel burning stove including a heat exchanger providing a supply of secondary heated air for increasing combustion temperatures and efficiency of the stove.

BACKGROUND OF THE INVENTION

Solid fuel burning stoves using wood, coal, etc. as a source of radiant heat are becoming ever more popular. However, as a result of increased fuel costs and the rising concern with respect to air pollution, strict manufacturing requirements have been put into place regarding the efficiency of such stoves.

It is known that these stoves do in fact operate more efficiently and emit fewer pollutants as a result of higher burning temperatures within the stove. There are a number of prior art references which show means for injecting heated secondary air to the combustion chamber of a stove to provide a more complete and clean burning of the fuel within the stove. These references include U.S. Pat. Nos. 4,766,876 issued Aug. 30, 1988 to Henry et al.; 4,677,965 issued Jul. 7, 1987 to Duerichen; 4,502,395 issued Mar. 5, 1985 to Barnett; 4,111,181 issued Sept. 5, 1978 to Canney; 4,360,000 issued Nov. 23, 1982 to Down; 4,343,288 issued Aug. 10, 1982 to Tjosvold; 4,672,946 issued Jun. 16, 1987 to Craver; 4,854,298 issued Aug. 8, 1989 to Craver; and 4,658,801 issued Apr. 21, 1987 to Black.

Some of the above structures such as the structure found in the Black patent use catalytic convertors for reducing exhaust pollution. These catalytic convertors are extremely expensive and subject to failure.

Generally all of the prior art structures require a substantial modification to a conventional solid fuel burning stove with a resultant dramatic increase in cost to the stove. Furthermore, the efficiency of operation of a number of these prior art structures is questionable.

SUMMARY OF THE PRESENT INVENTION

The present invention provides a solid fuel burning stove which is extremely efficient in its operation yet simple in design. More particularly, the solid fuel burning stove of the present invention includes a standard internal combustion chamber and primary air feed to the combustion chamber and additionally includes heat exchange means above and providing a secondary heated air feed to the combustion chamber. The heat exchange means has a horizontal layered substantially closed box-like construction including a heated gas outflow layer fed by hot exhaust gases from the combustion chamber, at least one secondary air inflow layer into which the secondary air is drawn from outside of the stove, a heat exchange wall between and isolating the gas outflow layer from the secondary air inflow layer, and an air feed from the secondary air inflow layer to the combustion chamber. The heat exchange means further includes an exhaust stack receiving opening for fitting an exhaust stack with the gas outflow layer without penetrating the secondary air inflow layer.

The heat exchange means simply fits to the stove above the combustion chamber and provides a deflecting guide for the exhaust through the heat exchange means before being emitted from the exhaust stack. The secondary air feed which passes through the layered construction of the heat exchange picks up heat from the exhaust gases and is then effectively injected into the combustion chamber to increase burning temperatures within and efficiency of the stove.

BRIEF DESCRIPTION OF THE DRAWINGS

The above as well as other advantages and features of the present invention will be described in greater detail according to the preferred embodiments of the present invention in which;

FIG. 3 is a sectional view looking in from one side of the stove shown in FIG. 1;

FIG. 4 is a front view of the heat exchanger shown in FIG. 2;

DETAILED DESCRIPTION ACCORDING TO THE PREFERRED EMBODIMENTS OF THE PRESENT INVENTION

Figure 1:
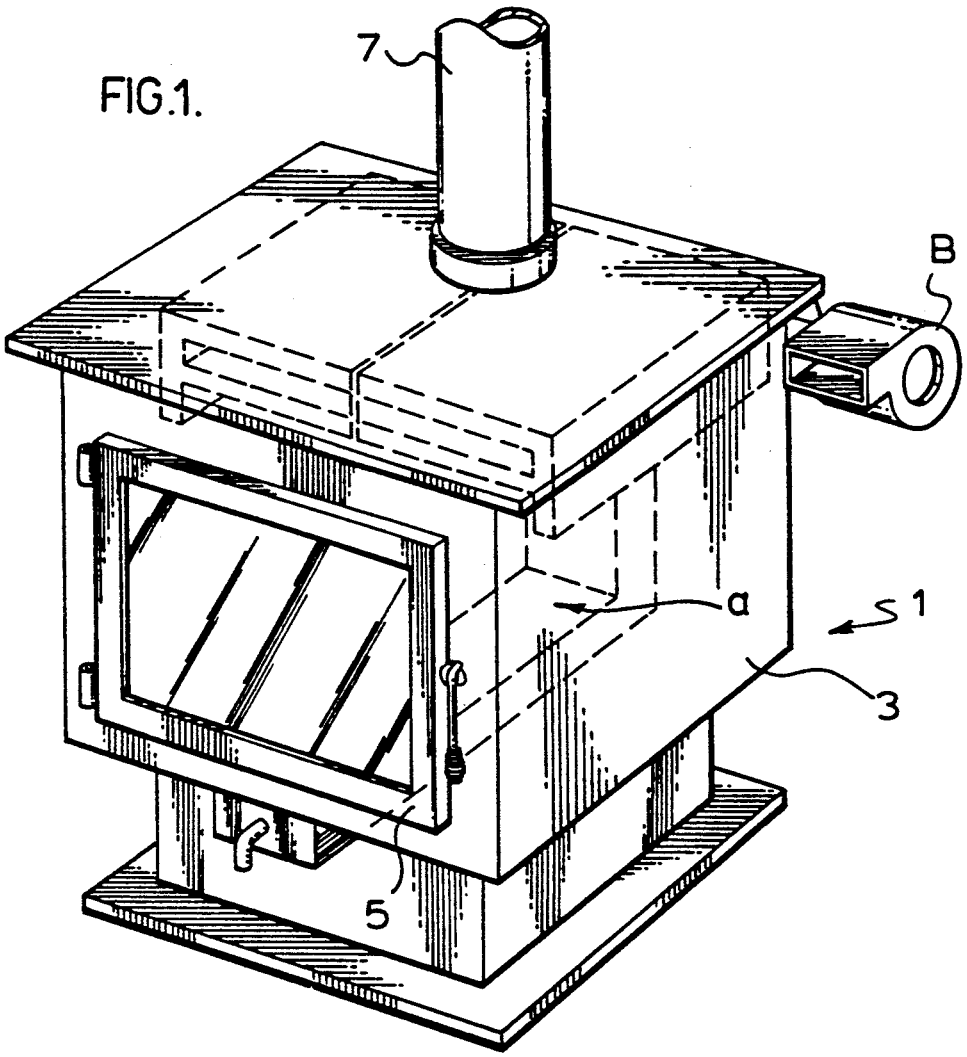
FIG. 1 is a perspective view of a solid fuel burning stove according to a preferred embodiment of the present invention.

FIG. 1 shows a stove generally indicated at 1. This stove includes a housing 3 having a forward access door 5 and an exhaust stack 7. A combustion chamber generally indicated at 9 is provided to the inside of the stove accessible through door 5. If desired, a blower B may be used to add to the radiant qualities of the stove.

Figure 2:
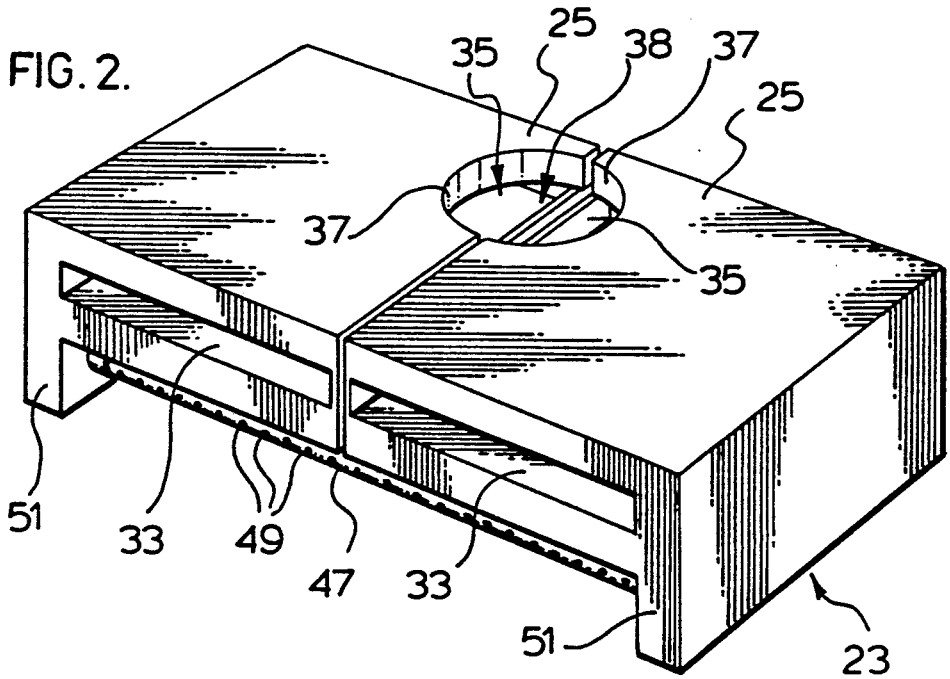
FIG. 2 is a perspective view of a heat exchanger used in the stove of FIG. 1.

The key to the stove lies in the provision of a heat exchanger generally indicated at 23 as well shown in FIG. 2 of the drawings. This heat exchanger fits directly within the stove immediately over the combustion chamber 9 beneath the top wall of the stove. The operation of the heat exchanger will be described layer in detail.

FIG. 3 shows both air and exhaust flow characteristics of the stove. A solid fuel such as coal or wood is burned within the combustion chamber which is fed by both a primary air feed and a secondary air feed through the heat exchanger 23. The air supply in both the primary and the secondary air feed is drawn by convection due to the heat within the stove and generally enters from behind the stove through an opening indicated at 17 at the base of the housing and upwardly through size adjustable openings 13 and 14. The exposure at each of these openings is adjusted by means of a slideable damper control 15. The air which passes up through opening 13 mostly travels to the front of the stove and passes directly up into the combustion chamber as shown to provide a primary source of combustion air. The air which passes up through opening 14 rather than going forwardly generally travels up through a channel indicated at 19 formed between the exterior housing 3 and an interior stove liner 11 through a rear opening 21 to the heat exchanger 23 as also shown in FIG. 3. After this air goes through the heat exchanger it provides the source of secondary heated air noted above.

Figure 5:
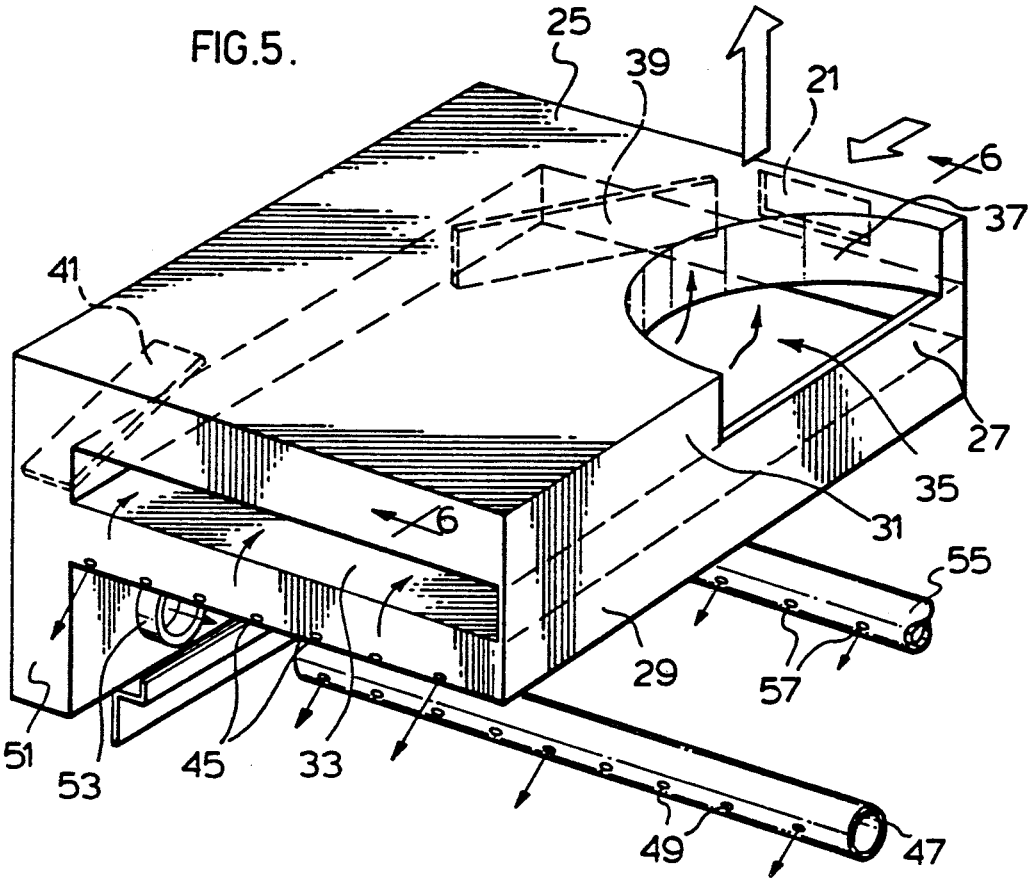
FIG. 5 is an enlarged exploded perspective view of one half of the heat exchanger from FIG. 2.
Figure 6:
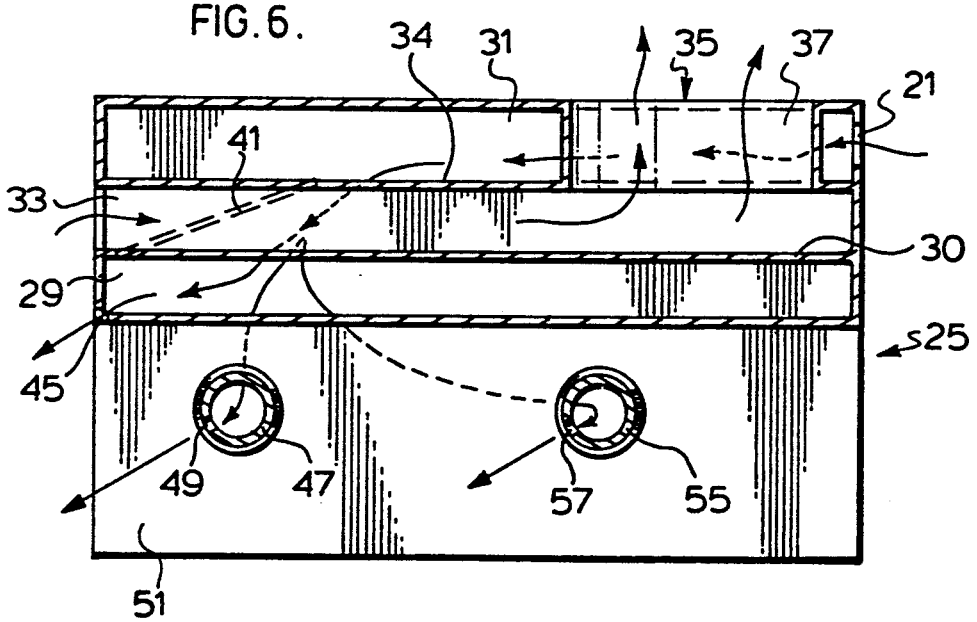
FIG. 6 is a sectional view taken through the center area of the heat exchanger of FIG. 2.

Returning to FIG. 2 and further having reference to FIGS. 4 through 6 of the drawings the heat exchanger itself has a box-like construction formed by horizontal layers extending through the heat exchanger. These layers include a central layer generally indicated at 27, a lower layer 29 immediately beneath layer 27 and an upper layer 31 atop the central layer. The central layer of the heat exchanger provides an exhaust flow path for the heated gases from the combustion chamber to the exhaust stack while the upper and lower layers 29 and 31 respectively separated from the central layer by heat exchange walls 34 and 30 provide secondary air inflow layers through the heat exchanger.

The gases resulting from the burning of the fuel in the combustion chamber rise upwardly but are prevented from escaping directly through the exhaust stack by the heat exchanger. The gas outflow layer 27 is open at its front side as indicated at 33 through which the exhaust gases are fed into the heat exchanger. These heated gases travel through the center layer in the heat exchanger which causes an induction of outside air through the opening 21 at the rear of the heat exchanger. This outside air flows initially into the upper layer 31 and is deflected forwardly by means of a baffle 39. A further baffle 41 at the front of the upper layer causes a downward deflection of the gases into the lower layer 29 of the heat exchanger. Note that the upper and lower layers while being in air flow communication with one another are totally isolated from the central gas outflow layer. Furthermore, the substantially closed construction of the heat exchanger provides a very effective trapping of both the exhaust gas and the secondary air for maximizing the efficiency of the heat exchange which occurs through both the top wall 34 and the bottom wall 30 of the central exhaust gas outflow layer. The heat exchanger including the heat conducting walls 30 and 34 is made from a highly heat conductive material to maximize the heat exchange properties between the exhaust gas and the air drawn into the heat exchanger.

The secondary air as it is heated within the heat exchanger expands and therefore attempts to force its way out of the heat exchanger. To allow the escape of the heated secondary air, the heat exchanger includes a first set of jet-like orifices 45 provided along the lower front edge of the lower layer of the heat exchanger. These jet like orifices are directed downwardly towards the combustion chamber and provide a source of heated secondary air to increase burning temperatures within the combustion chamber.

In addition, the heat exchanger includes a downwardly extending leg 51 provided with a collar 53. A pair of elongated transverse tubes 47 and 55 located to the front and the rear of the heat exchanger are fitted to leg 51. The heated air within the heat exchanger is forced down into leg 51 and along the tubes 47 and 55. Tube 47 is provided with jet-like orifices 49 while tube 55 is provided with similar orifices 57. The orifices of both the tubes are also pointed downwardly forwardly into the combustion chamber.

It will be noted from the description above that all of the feeding of secondary air is done from the lower regions of the heat exchanger. However, as noted above the secondary air enters from the rear of the top layer and must therefore flow forwardly and downwardly before being ejected from the heat exchanger. This maximizes the time in which the secondary air is trapped in the heat exchanger before being fed down into the combustion chamber and adds to the amount of heat transferred to the secondary air from the outgoing exhaust gases.

FIG. 2 shows a further preferred feature of the heat exchanger which is preferably made from two identical heat exchange members 25 which are mirror images of one another. This construction rather than having a single large heat exchanger provides benefits during the manufacturing of the heat exchanger and further makes the components easier and lighter to handle during the assembly of the overall stove.

As seen in FIG. 2, the two heat exchanger members 25 are placed side to side with one another. The lower legs 51 on each of the heat exchange members are connected by tubes 47 and 55 which provide an air flow path between the heat exchange members. In addition, each of the heat exchange members includes a semi-circular recessed or cut out region 35. These two regions align with one another when the heat exchange members are placed side by side to provide an exhaust stack receiving opening generally indicated at 38 in FIG. 2. This exhaust stack receiving opening extends down to the central gas flow receiving layer past the top air inflow layer of the heat exchanger. However the top secondary air inflow layer is blocked off from the exhaust opening by walls 37 around each of the semi-circular cut out regions 35. Therefore, even though the stack receiving opening extends to the center of the heat exchanger the incoming secondary air is blocked from the exhaust path.

In order to support the exhaust stack 7 over its receiving opening 38, an upright collar 8 as best shown in FIG. 3 is fitted to the stove. The exhaust stack then simply slides down over the collar aligned with opening 38.

It will now be seen from the description above that the construction of a solid fuel burning stove in accordance with the present invention is simple in design and yet is not substantially more expensive than a conventional stove. The inclusion of the heat exchanger does not add anything in the way of moving parts and is therefore not generally subject to breakdown. At the same time, the heat exchanger is extremely efficient in its operation and adds dramatically to the overall performance of the stove.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A solid fuel burning stove having an internal combustion chamber, a primary air feed to said combustion chamber and heat exchange means above and providing a secondary heated air feed to said combustion chamber, said heat exchange means having a horizontally layered substantially closed box-like construction including a heated gas outflow layer fed by hot exhaust gases from said combustion chamber, upper and lower secondary air inflow layers into which secondary air is drawn from outside of said stove, said air inflow layers being separated from said heated gas outflow layer by upper and lower heat exchange walls above and below said heated gas outflow layer in said heat exchange means and air feed means from said secondary air inflow layers to said combustion chamber, said heat exchange means further including an exhaust stack receiving opening for fitting an exhaust stack with said gas outflow layer without pentrating said secondary air inflow layers.

2. A solid fuel burning stove having an internal combustion chamber, a primary air feed to said combustion chamber and heat exchange means above and providing a secondary heated air feed to said combustion chamber, said heat exchange means having a horizontally layered substantially closed box-like construction including a heated gas outflow layer fed by hot exhaust gases from said combustion chamber, at least one secondary air inflow layer into which secondary air is drawn from outside of said stove, a heat exchange wall between and isolating said gas outflow layer from said secondary air inflow layer and air feed means from said secondary air inflow layer to said combustion chamber, said heat exchange means further including an exhaust stack receiving opening for fitting an exhaust stack with said gas outflow layer without penetrating said secondary air inflow layer, said heat exchange means comprising a pair of side by side heat exchange members each of which includes a cut out region opening to said heated gas outflow layer, the cut out regions in said heat exchange members aligning with one another to provide said exhaust stack receiving opening.

3. A solid fuel burning stove as claimed in claim 2, wherein said heat exchange members are of identical size and mirror images of one another, the cut out region in each member being semi-circular, the semi-circular cut out regions in said heat exchange members aligning with one another to provide a circular configuration for said stack receiving opening.

4. A solid fuel burning stove as claimed in claim 2, including at least one transverse secondary air flow connecting member between said heat exchange members.

5. A solid fuel burning stove as claimed in claim 4, including a forward and a rearward transverse secondary air flow connecting tube between said heat exchange members, each of said tubes being located to the underside of said heat exchange means and each tube including a plurality of small secondary air feed orifices along the length thereof directed downwardly at said combustion chamber.

* * * * *